United States Patent [19]

Quatrini

[11] Patent Number: 4,908,982

[45] Date of Patent: Mar. 20, 1990

[54] POST PLANT HANGER

[76] Inventor: Stephen J. Quatrini, 2307 Seaford Rd.; P.O. Box 543, Seaford, Va. 23696

[21] Appl. No.: 335,693

[22] Filed: Apr. 10, 1989

[51] Int. Cl.[4] ..... A47G 7/02

[52] U.S. Cl. ..... 47/39; 248/297.5

[58] Field of Search ..... 248/27.8, 297.5, 295.1, 248/303, 304, 315, 339, 519, 523, 524; 211/112, 119, 205; 47/39

[56] References Cited

U.S. PATENT DOCUMENTS

| | | | |
|---|---|---|---|
| 2,612,413 | 9/1952 | Polak | 248/295.1 |
| 2,774,562 | 12/1956 | Henry . | |
| 3,064,933 | 11/1962 | Brasty . | |
| 3,108,401 | 11/1963 | Richardson | 47/39 |
| 3,272,467 | 9/1966 | Kassube | 248/303 X |
| 3,815,853 | 6/1974 | Bahner | 248/524 |
| 4,261,138 | 4/1981 | St. George Syms | 248/523 X |
| 4,270,581 | 6/1981 | Claxton . | |
| 4,415,137 | 11/1981 | Garves . | |
| 4,524,542 | 5/1985 | Elliott . | |
| 4,534,129 | 8/1985 | Stucky . | |

FOREIGN PATENT DOCUMENTS

| | | | |
|---|---|---|---|
| 3431438 | 2/1986 | Fed. Rep. of Germany | 47/39 |
| 2397589 | 7/1977 | France | 248/297.5 |

*Primary Examiner*—Carl D. Friedman
*Assistant Examiner*—Jerrold D. Johnson
*Attorney, Agent, or Firm*—Wallace J. Nelson

[57] ABSTRACT

A one piece rubber coated metal rod bent into a series of angles to provide one end that slips onto and engages a square wooden post (4"×4", 6"×6", or 8"×8") with the other end angularly extending outwardly therefrom and provided with an end hook portion to support a suspended hanging plant, or the like, is disclosed. This hanging basket support 27 may be used with a half-barrel type container 11 having a layer of water absorbent material 17 in the bottom thereof. A square wooden post 19 has one end thereof received by container 11 and is supported by bracket(s) 18. A perforated washer-like bushing 21, having a periphery conforming to the interior of container 11, is positioned around post 19 and is supported thereon by brackets 25. A layer of decorative gravel or stone 24 and/or a layer of artificial grass or porous indoor-outdoor carpeting 22 is provided on disk 21 for aesthetic purposes. One or more hanging basket support brackets 27 are disposed in frictional engagement with post 19 to support flower or plant baskets 29. The entire assembly is easily assembled and disassembled and is adaptable for apartment or condo use where the use of nails, screws and other permanent type supports are prohibited.

7 Claims, 2 Drawing Sheets

POST PLANT HANGER

FIELD OF THE INVENTION

This invention relates generally to a plant hanger structure and relates in particularly to a bent wire device for supporting hanging baskets or the like on square posts and for an apparatus for supporting a post having a plurality of plant hangers thereon for displaying a plurality of hanging baskets.

BACKGROUND OF THE INVENTION

Hanging baskets of flowering plants are widely used as decorative items around the home or apartment. Some apartment and home dwellers are deprived of enjoying the beauty of hanging baskets because it is stipulated in their leases that no nails, wall brackets and the like may be attached to the apartment walls or to the outside porch or deck structures. There is thus a definite need in the art to provide a hanging mechanism that will support one or more hanging baskets and that does not require the use of nails, screws, or the like for support and that may be attached and removed without defacing or otherwise damaging the structure. Also, there is a need in the art for a portable, easily erected, support structure for hanging baskets and the like to permit use indoors, on decks, patios and the like, without defacing the walls of a structure.

It is therefore an object of the present invention to provide a bent wire bracket for supporting hanging baskets and the like that can be attached and removed from a vertical square post without the use of nails, screws or other defacing connectors.

It is another object of the present invention to provide a portable easily erected, and easily dismantled support structure for hanging baskets and the like.

A further object of the present invention is a non-destructive hanging bracket for supporting decorative items on a square post or the like.

An additional object of the present invention is a decorative support structure for supporting multiple hanging baskets and the like without the use of nails, screws and the like.

BRIEF DESCRIPTION OF THE DRAWINGS

A more complete appreciation of the invention and many of the attendant advantages thereof will be better understood when considered in connection with the accompanying drawings wherein.

DETAILED DESCRIPTION

Figure 2:
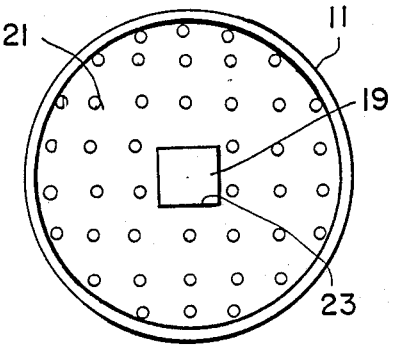
FIG. 2 is a sectional view taken along lines II—II of FIG. 1.
Figure 1:
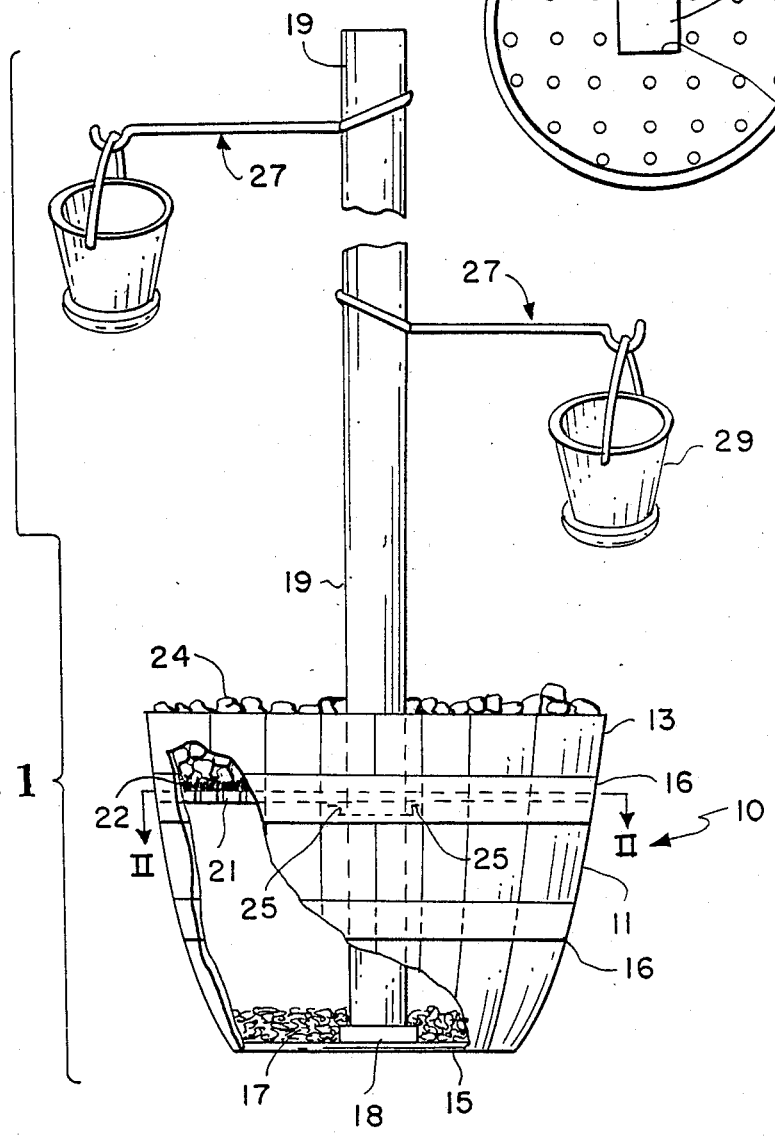
FIG. 1 is a side view, with parts broken away, of a post plant hanger support structure according to the present invention.

Referring now to the drawings and more particularly to FIG. 1, the post plant hanger of the present invention is illustrated and designated generally by reference numeral 10. Plant hanger 10 includes a base container 11 having an open end 13 and a closed or bottom end 15. An example type container suitable for use with the present invention is a section of a wooden barrel, or like container, with hoops 16 thereon. Barrel sections of this type are now commonly used as outdoor planters and are readily available from plant nurseries, building supply houses, and the like. These barrel containers have an essential tapered or frusto-conical configuration with the small end being positioned at the bottom closed end.

A layer of water absorbent material 17, such for example, commercially available Kitty Litter, is disposed in the bottom of the container as will be explained further hereinafter. A bracket support 18 is secured to the center of bottom end 15 on the interior surface thereof and designed to receive and maintain an end of a square post 19 therein. Support 18 consists of one or more conventional builder's angle brackets and are available from building supply and hardware stores. Brackets of this type are available as a single square unit or as individual corner brackets that would require the use of four to support all sides of post 19 and are secured to the bottom end 18 by nails, screws or other conventional fastening mechanism. The end segment of post 19 received by support 18 may be attached to the support by nails, screws, or the like, or may merely set within the bracket(s) when all four sides thereof are engaged, with gravity forces maintaining the post in position.

An annular perforated disk 21 is disposed about post 19 spaced from the bottom end 18 of container 11 and adjacent the open end 13 thereof. Perforated disk 21 is provided with a central square opening 23 therein to receive post 19 and serves as a washer-like bushing for post 19. Perforated disk 21 permits any water spilled or overflowing thereon during watering of plants or flowers disposed in containers 29 to pass through and be absorbed by absorbent material 17. One or more corner brackets 25 are attached to post 19 for supporting perforated disk 21. A porous layer of artificial grass or indoor-outdoor type carpeting 22, as well as a plurality of real or artificial light weight rocks 24, may be supported by perforated disk for aesthetic purposes.

A plurality of load support brackets 27 are positioned around and frictionally retained at spaced intervals along the length of post 19 to individually support a flower or plant container 29, commonly referred to as hanging baskets. As shown, each support arm of support brackets 27 is disposed essentially parallel with the floor or support surface for container 11.

Figures 3, 4, 5:
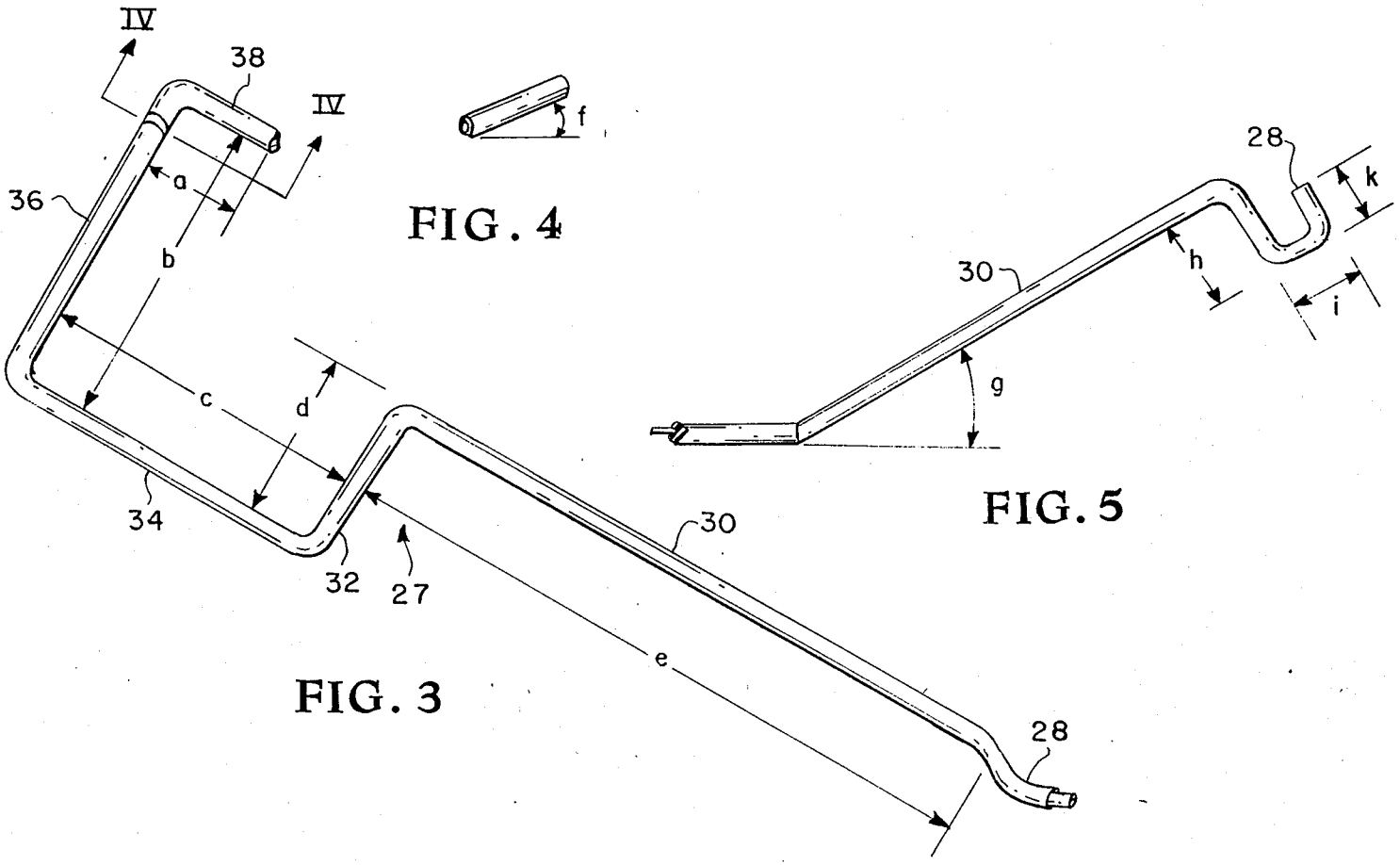
FIG. 3 is a enlarged view of the bent wire plant hanger shown on the post plant hanger of FIG. 1.
FIG. 4 is a view of the plant hanger of FIG. 3 and taken along lines IV—IV thereof.
FIG. 5 is a partial view of the plant hanger of FIG. 3.

Referring now more particularly to FIGS. 3–5 the details of an individual load support bracket 27 will now be described. In the preferred embodiment of the invention, pole 19 is a commercially available salt treated square pole designated as a 4"×4" pole. The actual cross-sectional measurements of these 4"×4" poles is generally three and three-quarters inches on each side as is well recognized in the lumber trade. Support bracket 27 is formed of one-quarter inch diameter, rubber coated steel rod. The container support end or hook 28 of support bracket 27 is bent on a radius of one-half inch to provide dimensions represented by lines h, i, and k, respectively, of one and one-half inches, one inch and one inch. The elongated extension of load support bracket 27, designated by reference numeral 30 (FIGS. 3 and 5) is approximately ten inches in length as designated by line e and is bent at an angle g of 29° relative to the three planar sides of hanger 27 positioned around post 19. The side of hanger 27 merging with elongated extension 30, is designated by reference numeral 32. Side 32 has a length of one and three-quarter inches as measured along line d. Side 34 merges at a 90° angle with and is on the same horizontal plane as side 30 and extends a distance of three and three-fourths inches as indicated by line c. Side 36 is parallel with side 32 and merges at a 90° angle with, and is on the same plane as, side 34. Side 36 has a length slightly shorter than that of side 34, or three and one-half inches, as indicated by line b. This shorter side, being opposite to elongated support 30, helps maintain bracket 27 in frictional locked position on post 19. Side 38 merges with side 36 and is bent at an angle of 35° from the horizontal plane of sides 32,34, and 36 and in a direction opposite to the angular bend of elongated extension 30. Side 38 is approximately one inch in length as indicated by line a.

These specific dimensions are for a specific exemplary embodiment and slight variations therein are considered within the scope of the present invention. For example, the steel rod thickness need not be confined to one-quarter inch diameter. Greater thicknesses may be employed where additional strength is needed or smaller steel wire rod may be employed where less weight support is required. Thus, the range of steel rod thickness considered operable in practice of the present invention is considered to be one-eighth to one-half inch. For practice of the present invention with 6"×6" and 8"×8" salt treated posts, the dimensions for portions represented by lines a. b, c, and d would be altered accordingly, with the remaining linear and angular dimensions remaining the same as described herein.

As shown in FIG. 1, when load support brackets 27 are constructed of the dimensions described are positioned on a 4"×4" post, the elongated segments 30 thereof will remain essentially parallel with the ground or support surface for post 19.

Although the invention has been described relative to specific embodiments thereof, it is not so limited and numerous variations and modifications thereof may be made without departing from the spirit and scope of the invention. For example, where specific materials have been mentioned, the invention is not confined to the exemplary examples. In lieu of the wooden barrel halves mentioned for container 11, any plastic, pottery, or other wooden structures may be employed in tapered or frusto-conical configuration or of uniform diameter construction. The perforated disk 21 may be constructed of wood or plastic and is designed to support decorative grass carpeting 22 and artificial rocks 24 while permitting any water overflowing from containers 29 to pass therethrough for absorption by absorbent material 17. Post 19 is not restricted to wood and could be formed of lightweight aluminum, plastics, composites or the like as long as it has the strength to support one or more containers 29.

These and other variations and modifications will be readily apparent to those skilled in the art in the light of the above teachings without departing from the scope of the appended claims. Thus, the invention may be practiced other than as specifically described herein.

What is claimed as new and desired to be secured by Letters Patent of the United States is:

I claim:

1. Apparatus for supporting one or more hanging baskets comprising, in combination:

(a) a container having an open end and a closed end;

(b) a post having one end disposed within the open end of said container and in engagement with the closed end thereof, and the other end of said post being vertically extended above said container;

(c) a washer-like bushing positioned around said post and having a circumference mating with and engaging the interior of said container, said washer-like bushing being a perforated disk and spaced from the bottom of said container;

(d) at least one hanging basket support bracket having a first end releasably disposed about said post adjacent the end thereof vertically extending above said container;

(e) said hanging basket support bracket having a second end spaced from said post and having a hook formed thereon adapted to receive and support a hanging basket load suspended from said bracket; and (f) at least one corner bracket support attached to said post for engaging and supporting said perforated disk therearound.

2. The apparatus of claim 1 wherein said container is of an inverted frusto-conical configuration and said perforated disk is provided with a tapered circumference mating with and wedging against the interior of said container.

3. The apparatus of claim 1 including a layer of porous decorative material supported on said perforated disk.

4. The apparatus of claim 1 wherein said support pole is a wooden pole having a square cross-sectional area and said first end of said support bracket is bent to provide three 90° angle corners disposed within the same plane and serving to engage three corners of said square cross-sectional area and the terminus of said first end is angularly bent at substantially a vertical 35° angle from the plane of said support bracket corners.

5. Apparatus for supporting one or more hanging baskets comprising, in combination:

(a) a container having an open end and a closed end;

(b) a post having one end disposed within the open end of said container and in engagement with the closed end thereof, and the other end of said post being vertically extended above said container;

(c) a washer-like bushing positioned around said post and having a circumference mating with and engaging the interior of said container, said washer-like bushing being a perforated disk and spaced from the bottom of said container;

(d) at least one hanging basket support bracket having a first end releasably disposed about said post adjacent the end thereof vertically extending above said container;

(e) said hanging basket support bracket having a second end spaced from said post and having a hook formed thereon adapted to receive and support a hanging basket load suspended from said bracket; and (f) a quantity of moisture absorbent material disposed between said perforated disk and the bottom of said container.

6. The apparatus of claim 5 wherein said support pole is a wooden pole having a square cross-sectional area and said first end of said support bracket is bent so as to provide (a) a length thereof extending in a plane around two sides of said pole, (b) a free end length disposed on a third side of said pole angularly bent upward from the plane of said two sides and (c) a segment approximately one-half the width of a pole side and in the same plane as said length extending around said two sides of said pole, and said segment having an integral extension angularly bent downward relative to said plane and extending from said pole and terminating in said second end of said bracket.

7. A support bracket for supporting a hanging basket or like container suspended from a vertical post having a square cross-sectional area comprising:

a bent rubber coated steel rod having a first and a second end, said first end of said bent steel rod being bent on a one-half inch radius to provide an open hook terminus, an elongated straight extension of said bent steel rod leading from said open hook terminus to merge with an angularly disposed first length of said rod, said angularly disposed first length of said rod merging at a substantially 90° angle with a second length of said rod, said second length of said rod being on the same horizontal plane as said angularly disposed length of said rod and merging at a substantially 90° angle with a third length of said rod, said third length of said rod being on the same horizontal plane as said first and said second lengths of said rod and being disposed parallel with said first length of said rod, a fourth length of said rod merging with said third length of said rod at an angle of substantially 35° with respect to the horizontal plane occupied by said first, second and third lengths of said rod, whereby said first, second, third and said fourth lengths form said second end of said rod and wherein said second end of said rod is adapted to frictionally engage a vertical post extending from a support surface and having a square cross-sectional area to thereby position said elongated straight extension of said rod and said open hook terminus thereof on a substantially horizontal plane with the support surface for the vertical post.

* * * * *